US005188349A

United States Patent [19]

Honegger

[11] Patent Number: 5,188,349

[45] Date of Patent: Feb. 23, 1993

[54] METHOD AND APPARATUS FOR INSERTING PRINTED PRODUCTS IN A FOLDED MAIN PRODUCT

[75] Inventor: Werner Honegger, Tann Rüti, Switzerland

[73] Assignee: Ferag AG, Hinwil, Switzerland

[21] Appl. No.: 890,102

[22] Filed: May 29, 1992

[30] Foreign Application Priority Data

Oct. 7, 1991 [CH] Switzerland ..... 2971/91
May 29, 1992 [CH] Switzerland ..... 1730/92

[51] Int. Cl.[5] ..... B65H 5/30
[52] U.S. Cl. ..... 270/55; 270/57; 271/204; 271/277
[58] Field of Search ..... 270/30, 31, 54, 55, 270/57, 58; 271/204, 206, 277

[56] References Cited

U.S. PATENT DOCUMENTS 2,634,971 4/1953 Schweizer ..... 270/55
4,743,005 5/1988 Reist ..... 270/55
4,871,159 10/1989 Petersen ..... 271/204
5,110,116 5/1992 Kobler et al. ..... 271/204

*Primary Examiner*—Edward K. Look
*Assistant Examiner*—Gregory Bulla
*Attorney, Agent, or Firm*—Walter C. Farley

[57] ABSTRACT

Folded main products (H) are brought from an inserting drum (2) with a fold directed at right angles to the conveying direction and in the open state to an acceptance station (U), where they are gripped at edges facing the fold by grippers in such a way that a gripper always grips the rear folding part ($H_h$) of a main product in the conveying direction together with the front folding part ($H_v$) of the following main product. As an almost continuous folding belt the main products are conveyed through an insertion section (1), whilst from above and between the grippers the insert products (E) are inserted in the main products.

30 Claims, 8 Drawing Sheets

Figure 1:
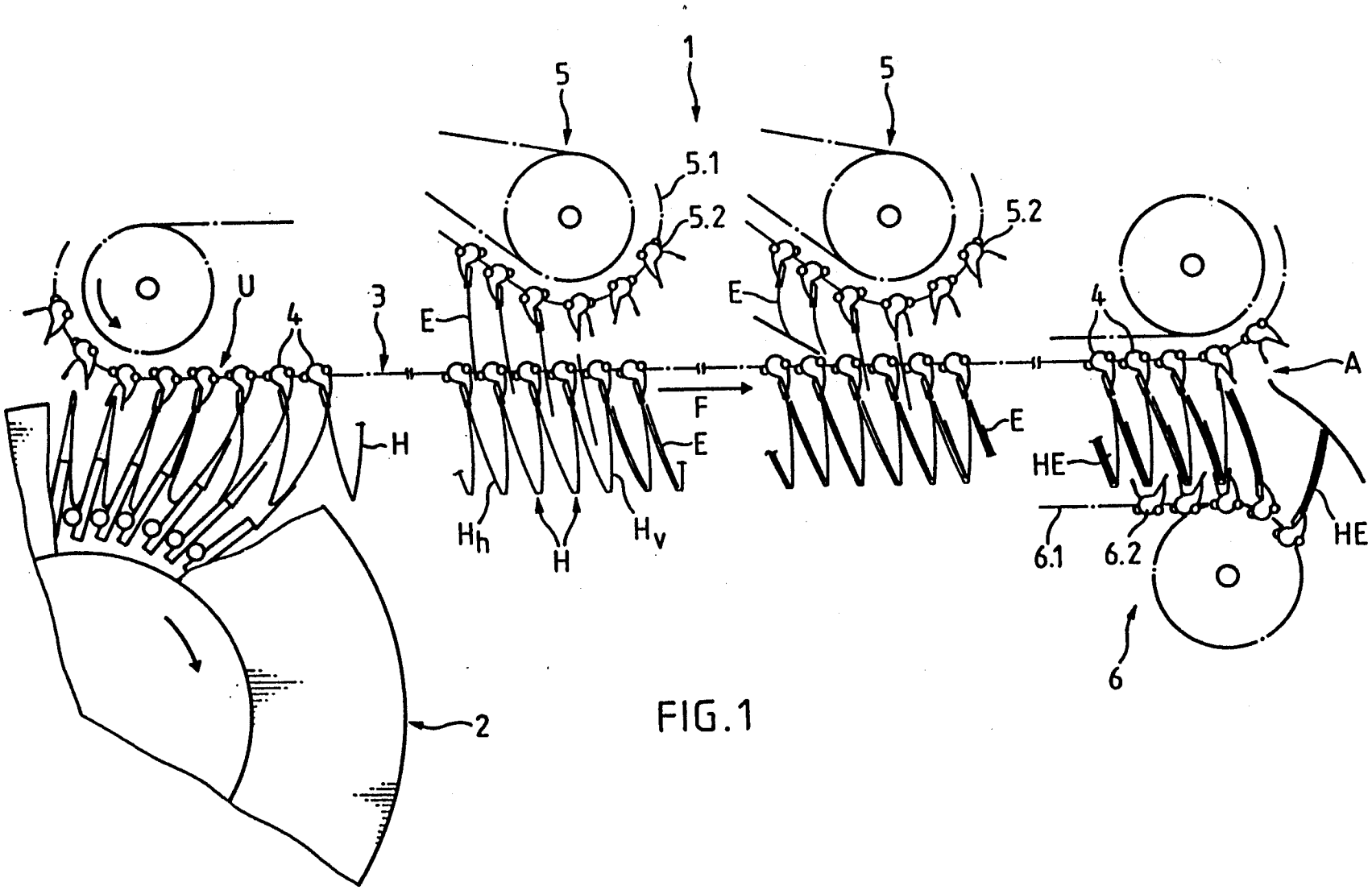

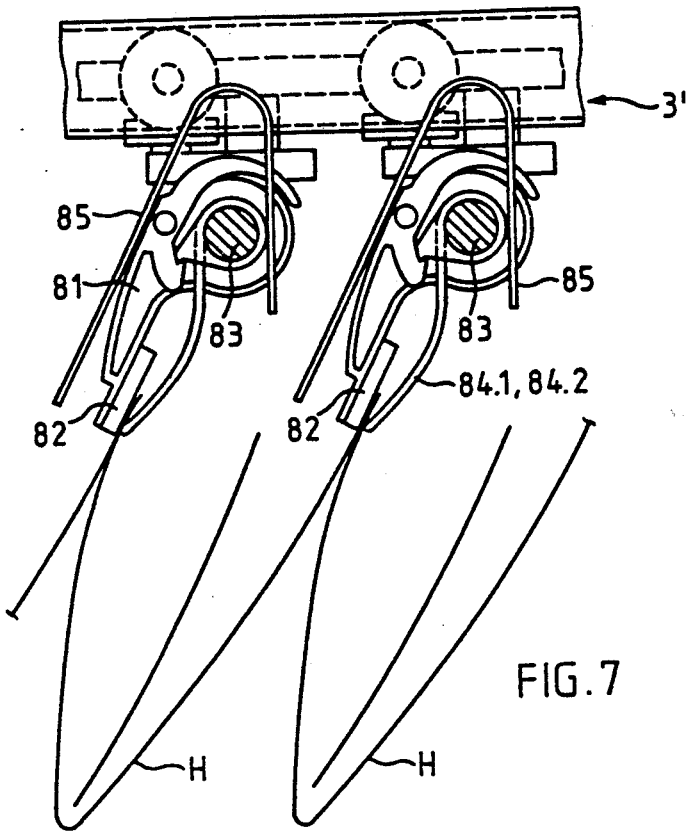
FIG. 7
FIG. 8
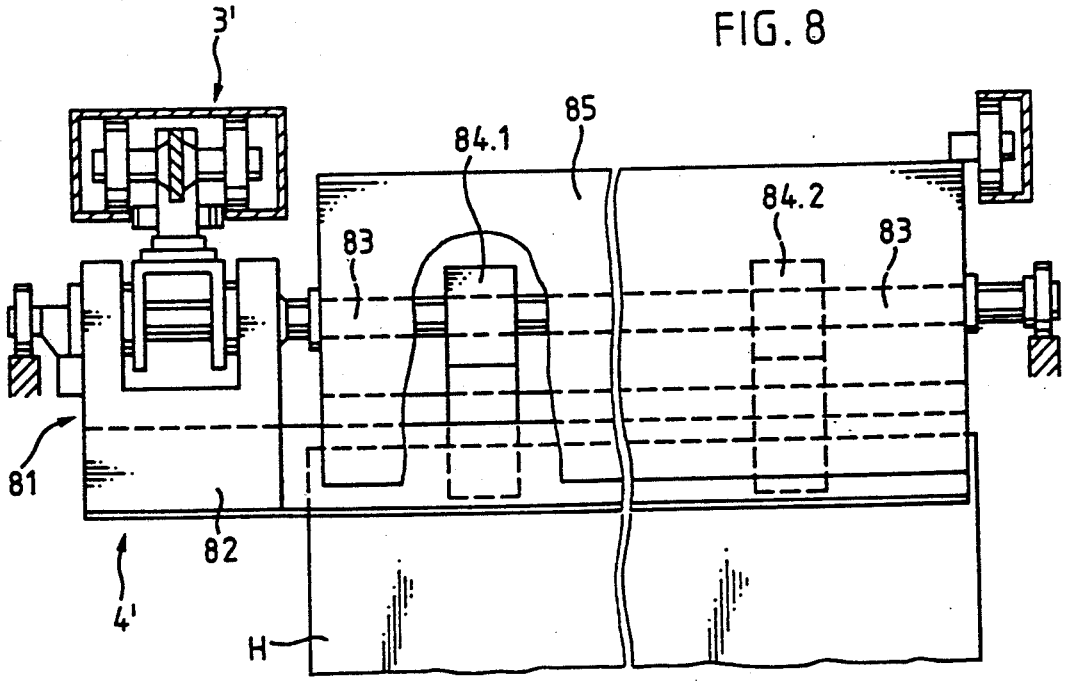

METHOD AND APPARATUS FOR INSERTING PRINTED PRODUCTS IN A FOLDED MAIN PRODUCT

The invention is in the field of the further processing of printed products and relates to a method and an apparatus according to the preambles of the corresponding independent claims with which different printed products can be inserted in a folded main product during the continuous conveying of the latter.

For producing a ready-to-despatch unit (end product) e.g. preliminary products or supplements (insert products) are inserted in a folded newspaper (main product). For this purpose the folded main product is opened and the insert products or inserts are placed between the folding parts of the main product, advantageously during the continuous further conveying of the main product. For example an inserting drum is used for such continuous insertion. The drum has a plurality of cells, in which the main products are conveyed and to which the insert products are successively supplied.

Inserting drums are e.g. described in Swiss patent 584,153 of the same Applicant. They consist of cell drums, in which the main product, e.g. as a scale flow is inserted, in each case one product per cell. During the first revolution the main product is opened and moved in the axial direction of the drum in the cell. During a second revolution a first single insert product or a first group of such insert products is inserted and the main product, together with the insert products are displaced in the drum axial direction for a further insertion process. In the same way it is also possible to insert several insert products or insert product groups. To maintain the production speed high, the cells must be as narrow as possible. Wider cells lead to larger drum diameters or higher numbers of revolutions for the same production speed and both of these requirements leads to higher mass accelerations, which is undesirable. Using the known inserting drums the volume of the insertable products is limited less by the shape and size of the main product than by the shape and size of the inserting drum cells. In addition, the products must be moved into the cells, which leads to mechanical friction, which has to be overcome.

Continuous methods are known for collecting printed products and for this purpose e.g. a conveying means with collecting pockets is used and continuously moved passed different supply points by means of a pulling member and at these points it is loaded with products. Such a method and a corresponding apparatus are e.g. described in Swiss patent 668,245 of the same Applicant. Also in the case of said collection the volume of the collectable products is mainly dependent on the shape and size of the pockets. It once again applies here that wider pockets for higher product volumes, for the same production speeds, leads to higher conveying speeds. For very different collecting volumes use is advantageously made of different products, which means a reequipping of the apparatus.

The problem of the invention is to provide an improved method and a correspondingly improved apparatus with the aid of which insert products can be inserted into a continuous flow of folded main products. The volume of the insertable printed products is to be made much less dependent on the apparatus than is the case in known apparatuses of this type. It must be possible to insert large insert product volumes even at very high production speeds. The apparatus must be simple to construct and without special interfaces must be integratable into known printed product conveying systems.

The inventive product is based on the fact of using the folded main products so-to-speak as collecting pockets. For this purpose they are conveyed by a plurality of grippers to a pulling member with the fold directed downwards and at right angles to the conveying direction in such a way that each gripper secures from above the rear folding part of a main product in the conveying direction and the front folding part of the following or follow-up product. Thus, the two folding parts of a main product are secured at the top by in each case one gripper and that the main product hanging between the two grippers forms an upwardly open inserting pocket. Between the grippers a supply takes place from above at a plurality of inserting points of insert products or groups of such insert products. The volume of products to be inserted in total is in this case primarily determined by the spacing of the grippers. The volume of the products which can be inserted in an individual insertion process is determined by the space available between the grippers. As the spacing of the grippers and therefore the space accessible between them can be rendered variable by known methods, at least over limited conveying distances, the possible volume of insert products is substantially independent of the apparatus and is only dependent on the size and shape of the main product.

In the method according to the invention the main products are held and conveyed at the top and insertion also takes place from the top. As a result the pulling member for the insertion path is not positioned above the conveyed products, but instead laterally thereof.

The only requirement made by the inventive method on the main product is that it is folded or foldable. It can e.g. be a single or a double fold, a single folded sheet or several folded sheets inserted in one another.

The inventive method and inventive apparatus are described in greater detail hereinafter relative to the attached drawings, wherein show:

FIG. 1 a diagram for an exemplified variant of the inventive method for inserting printed products in a folded main product.

Figure 2:
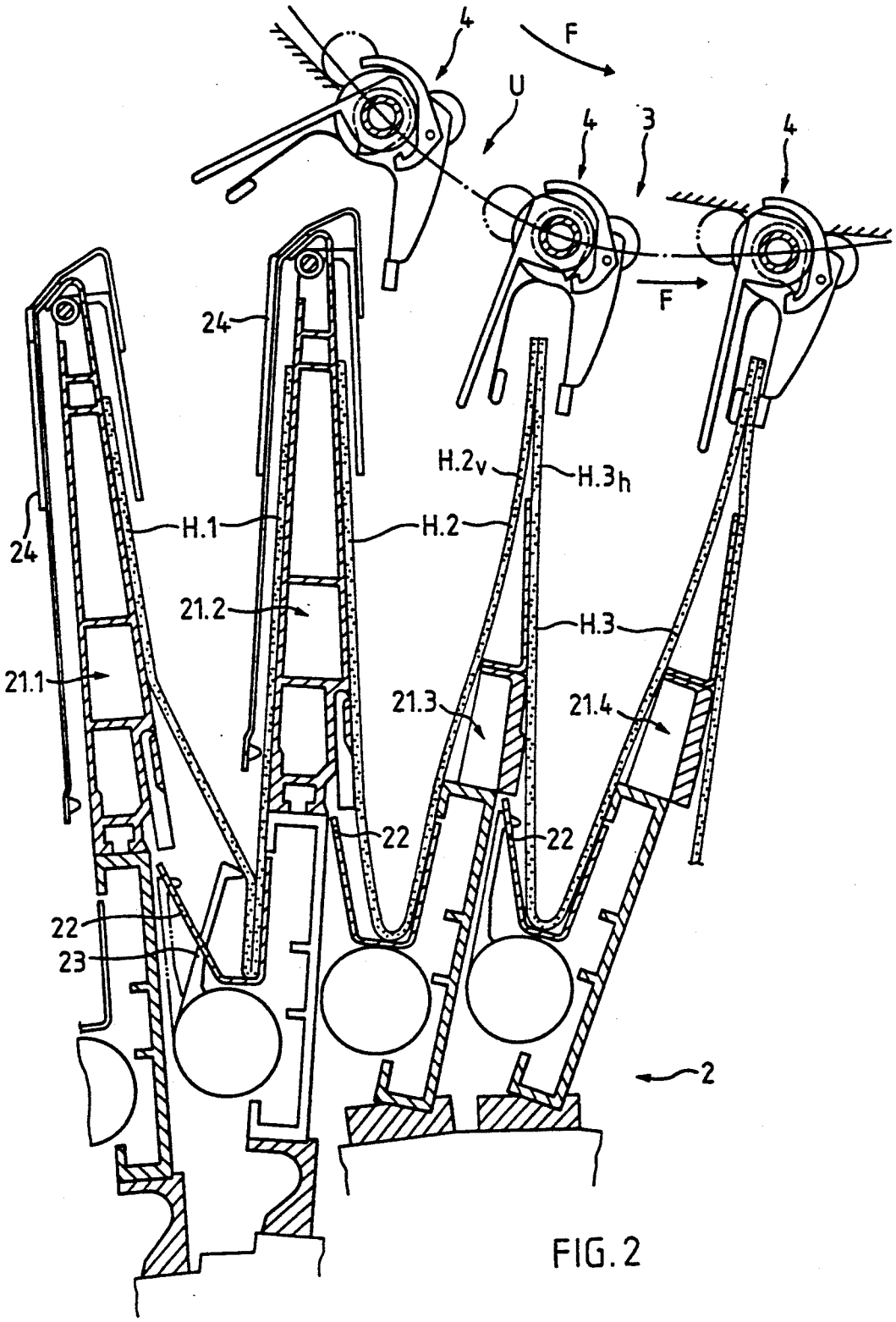

FIG. 2 a detail of the acceptance of the main products, as a view at right angles to the conveying direction.

Figure 3:
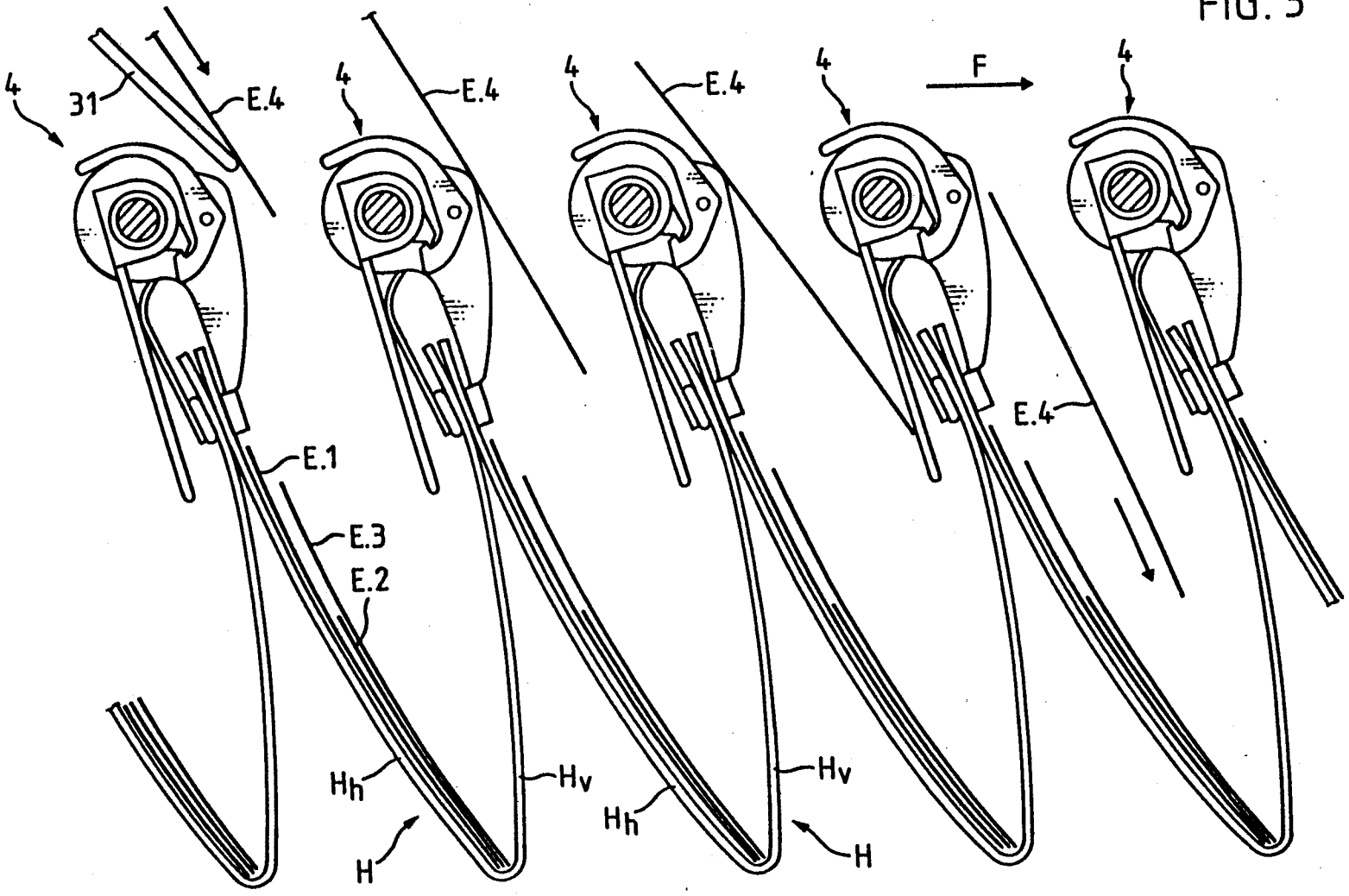

FIG. 3 a detail of the insertion as a view at right angles to the conveying direction.

Figure 4:
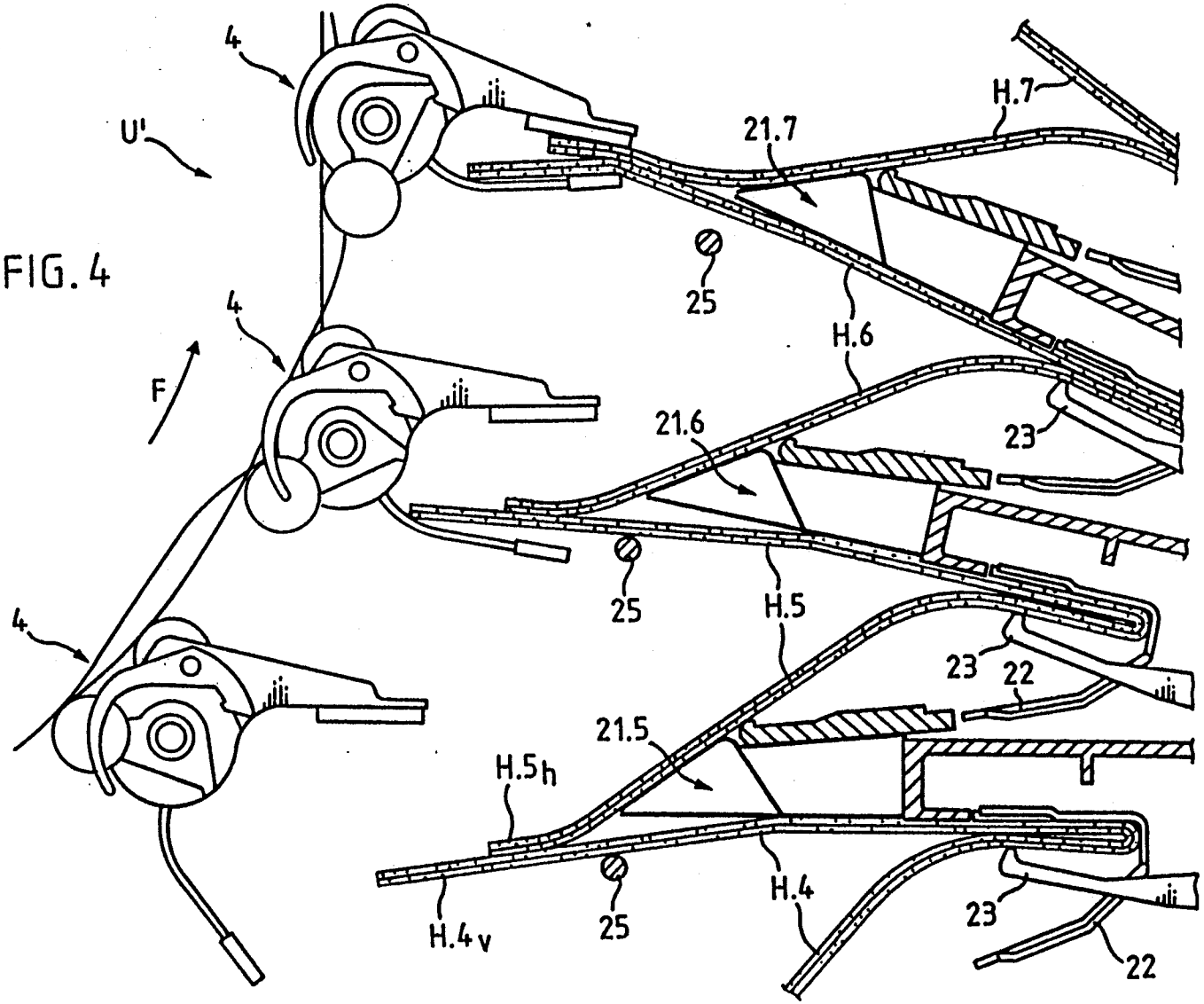

FIG. 4 a detail, as in FIG. 2, of the acceptance of the main products for a further method variant.

Figure 5:
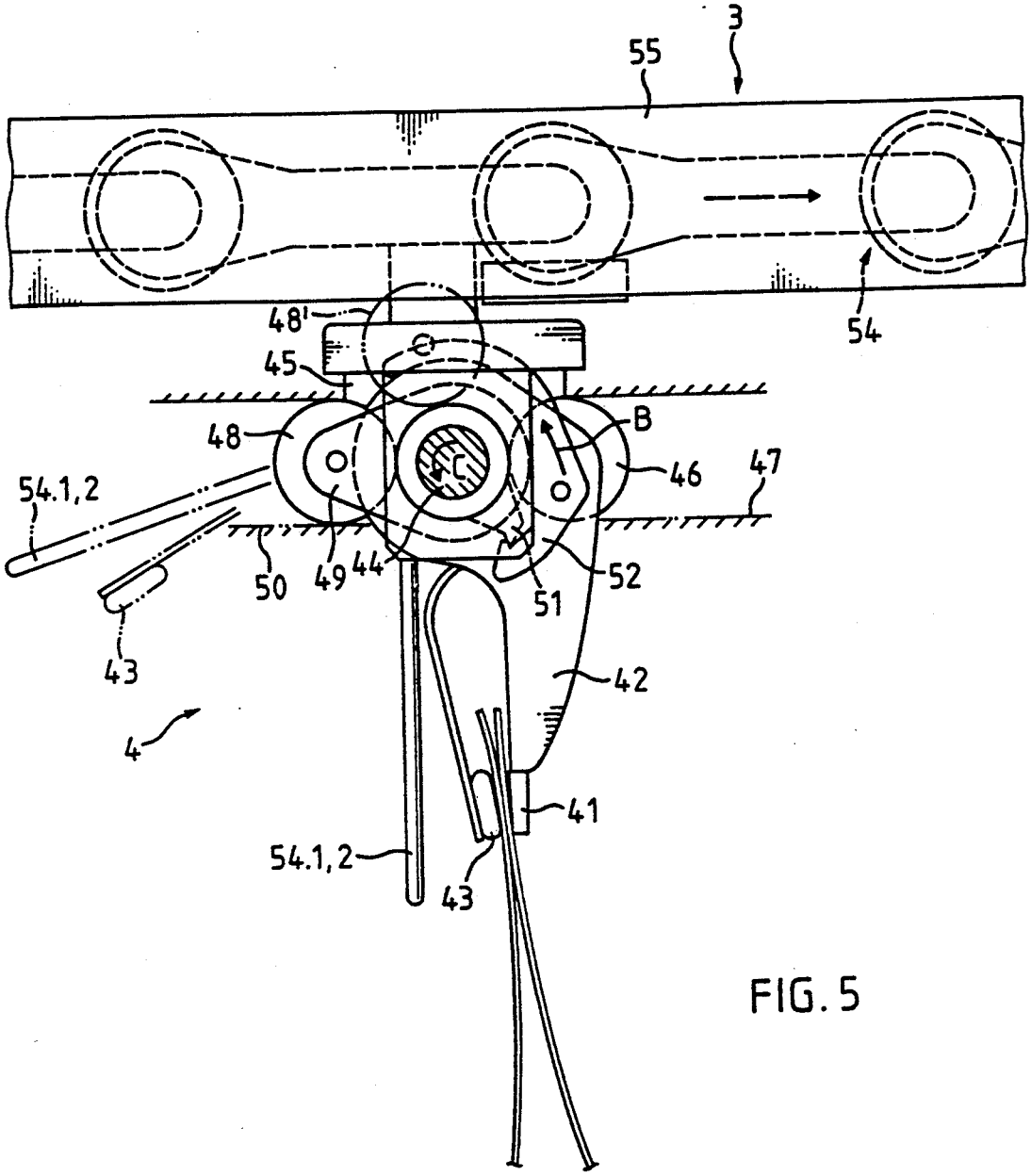

FIG. 5 an exemplified embodiment of a gripper as a view at right angles to the conveying direction.

Figure 6:
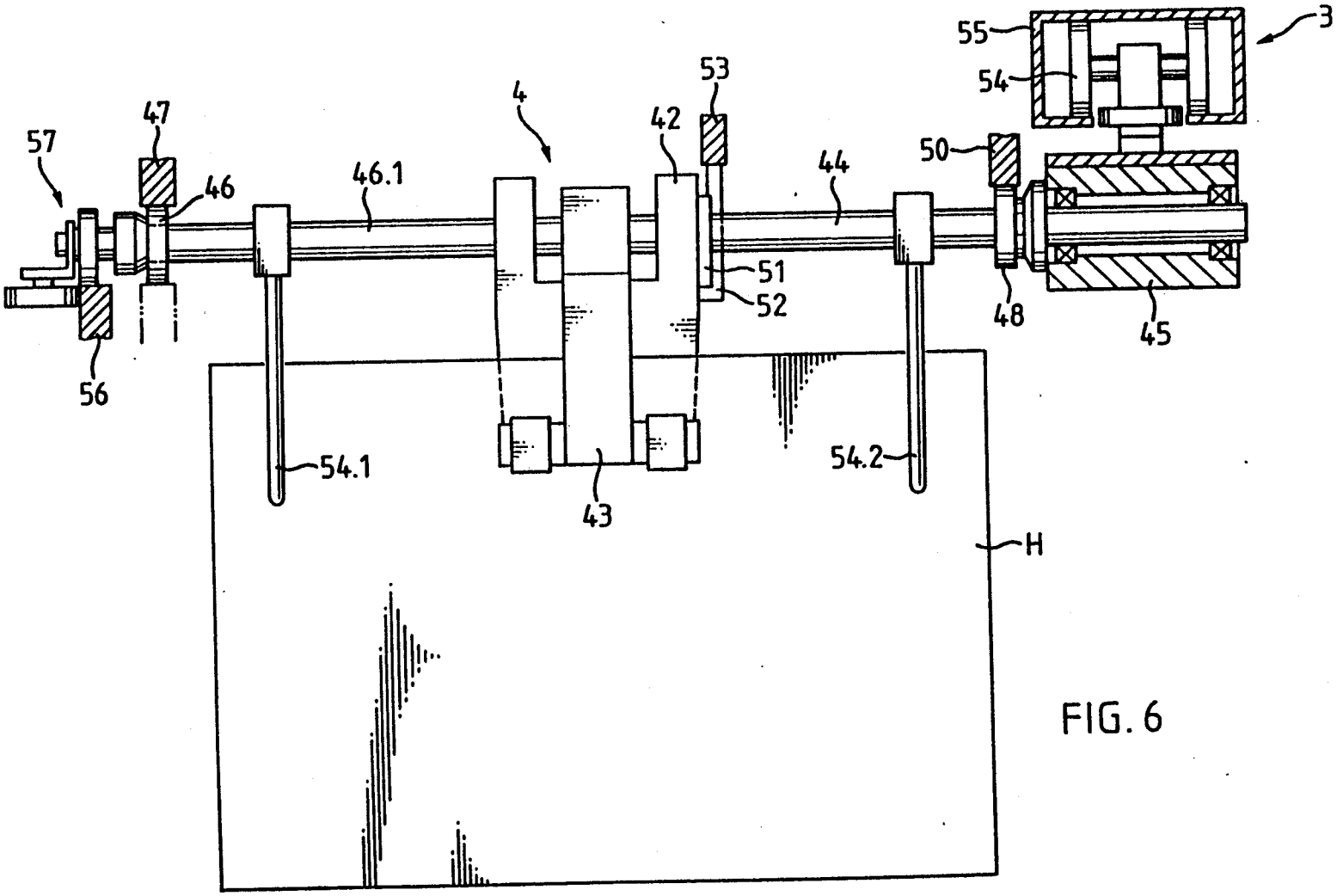

FIG. 6 the gripper according to FIG. 5 in a view parallel to the conveying direction.

FIG. 7 a further exemplified embodiment of the gripper as a view at right angles to the conveying direction.

FIG. 8 the gripper according to FIG. 7 in a view parallel to the conveying direction.

Figure 9:
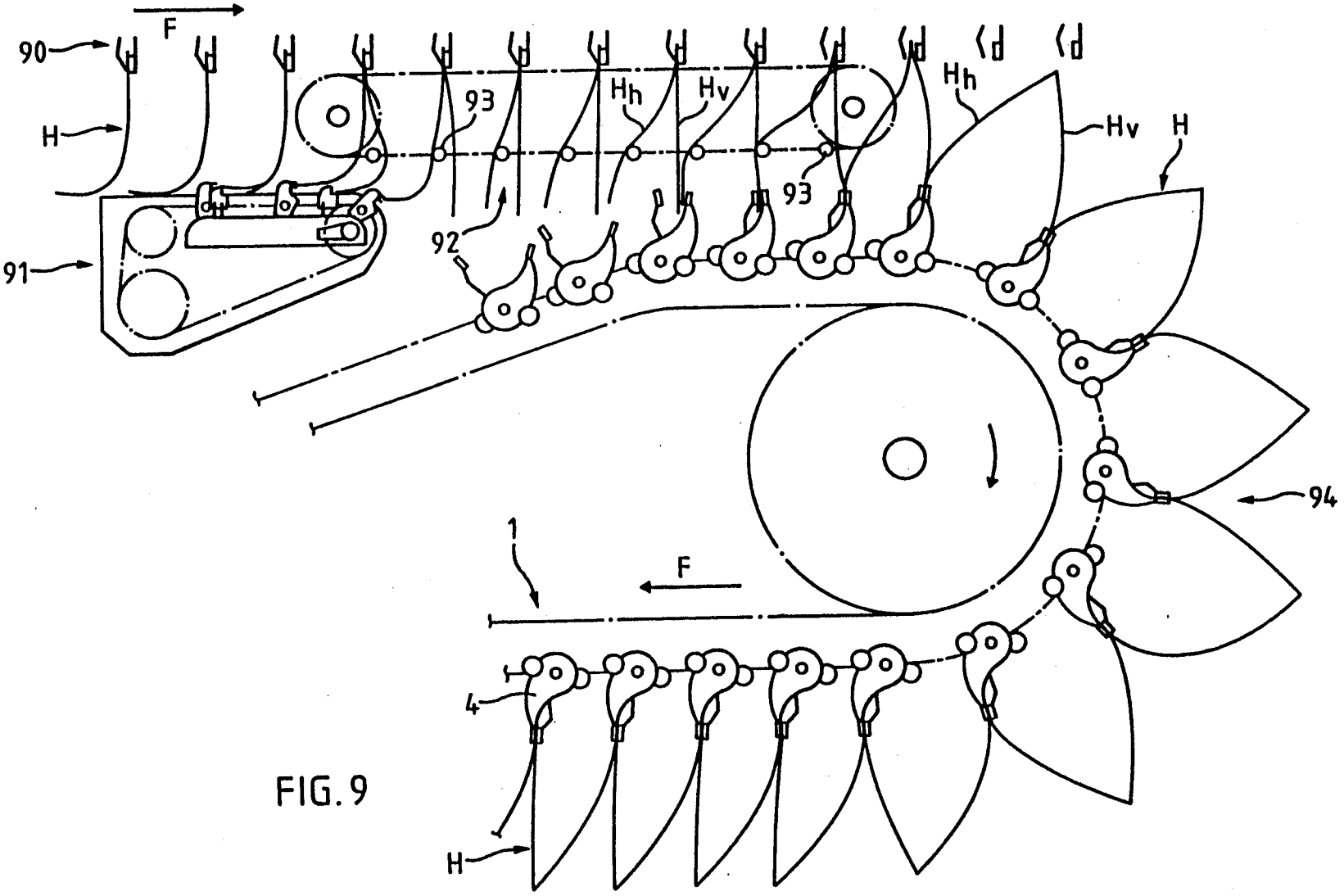

FIG. 9 another variant regarding the acceptance of the main products by the conveying means of the inserting section.

FIG. 1 is a diagram of an exemplified variant of the inventive method for inserting printed products in a folded main product. The main products H are continuously supplied open, with the fold to the bottom, to the insertion section 1. This is e.g. brought about with an inserting drum 2, such as is e.g. known from the Applicant's own Swiss patent 584,153 or European patent 241,634, which are here assumed as known. Into the said inserting drum 2 the main products are introduced in the form of a scale flow with in each case one main product per cell (not shown in the drawing). During a revolution of the main products in the drum, they are opened and displaced in the direction of the drum axis by at least their width at right angles to the conveying direction and parallel to the drum axis. Following this single revolution in the inserting drum the main products are taken over from the inserting drum (acceptance point U) by a plurality of grippers 4 moved substantially tangentially to the inserting drum by a pulling member 3 (diagrammatically shown as a dot-dash line). Each gripper 4 grips the rear folding part of the main product considered in the conveying direction F and the front folding part of the following or follow-up product. These two folding parts project with their edges remote from the fold and immediately adjacent to one another from adjacent cells of the inserting drum and can easily be gripped by a gripper, which is synchronized with the inserting drum and moved oriented with the cell partition. The main products H and grippers F are conveyed in displaced manner to the acceptance point, i.e. they have substantially the same spacings, but are phase-shifted by half a spacing relative to the centre of the main products.

The pulling member 3 conveys the grippers 4 and the main products H, which together virtually form a continuous folding belt, on the inserting section 1 below a random number of inserting stations 5 and passed the latter in such a way that from them and from above individual insert products E or insert product groups between the grippers and through into the main products. The supply from above of the insert products is e.g. brought about by a supply conveyor 5.1 with controllable clips or clamps 5.2, the latter conveying the insert products E in freely suspended or hanging manner and the supply conveyor 5.1 has substantially the same conveying direction as the insertion section 1 and approaches the latter from above under an acute angle.

The end products HE, i.e. main products H, in which all the insert products E are inserted are transferred in a delivery station A, e.g. to a transfer system 6. The latter can be a further conveyor 6.1 with controllable clips or clamps 6.2, the latter gripping the end products HE from below, i.e. at the fold of the main product. The transfer system 6 is so synchronized with the insertion section 1 that the time clip intervals are the same and the clips of the transfer system 6 reliably guide the end products HE before the grippers 4 of the insertion section 1 open and release the main products.

The main advantage of the inventive insertion method is that the main products H are held on the same side by the grippers 4 as insertion takes place and not, as in the known systems on the fold side. Each main product H hangs freely with the fold downwards between two grippers 4. As the fold area is not mechanically secured, its shape is more particularly dependent on the already inserted insert products. The insert products E are moved as low as possible into the fold by gravity and by the slight movement of the main product H produced as a result of the conveying action.

In order that the insert products E already located in the main product H can assume a clearly defined position relative thereto when further insert products E are inserted, it is advantageous not to convey the main product hanging in the precisely vertical direction and instead for the fold of each main product to be forwardly displaced in the conveying direction with respect to the median perpendicular between the two grippers, which hold the product. Thus, the rear folding part $H_h$ of the main product in the conveying direction forms a depositing surface for the insert products. This can be brought about in different ways, particularly by a corresponding position of the grippers at the insertion points, which will be described in greater detail in conjunction with FIGS. 3, 4, 5 and 6.

Also during the acceptance of the main products H by the grippers 4 of the insertion section 1 and during the delivery of the end products HE to the transfer system 6, it is advantageous to be able to control to a certain extent the hanging or suspended position of the main products H, so that they can be accepted or delivered in frictionless manner. Thus, as shown in FIG. 1, for the acceptance from an insertion drum it is advantageous to have a position with a trailing fold edge, whereas for the delivery a position with a leading fold edge is advantageous.

Variants of the method shown in FIG. 1 comprise the supply of the main product H into the insertion section 1 not taking place by an inserting drum 2, but by some other conveying means. With respect to the latter the requirement is made that the main products H are fed with the fold edge at right angles to the conveying direction (towards the top or bottom) and in the open state to the acceptance point (U), in such a way that the two folding parts ($H_v$, $H_h$) of each main product can be individually gripped at the edge facing the fold edge.

According to a further variant the supply of insert products E does not take place through supply conveyors 5.1 with clips 5.2, but by a different conveying system. The latter must fulfil the condition that the insert products or groups thereof are conveyed in a substantially vertical position and with a free or guided lower edge to the insertion point.

Another variant comprises the end products HE not being transferred to a conveyor 6.1 with clips 6.2, but instead to a different conveying system. The latter must be constructed in such a way that it can receive the end products HE in a substantially perpendicular position with a downwardly directed fold edge of the main product H and that it can support and guide the end products from the fold side before the grippers 4 of the insertion section 1 open and release the main products.

Another method variant comprises the insertion section not being a conveying section with constant gripper spacings, but instead a conveying section on which the gripper spacings vary. Apparatuses for such conveying sections are e.g. described in the Applicant's European patent 309,702, which is here assumed as known. Such a conveying section can e.g. be designed and controlled in such a way that the gripper spacing is increased at the insertion point and in that the pockets formed by the main products for the insertion of more voluminous insert products are wider open.

Another variant comprises that each folding part of each main product is gripped by a separate gripper and conveyed over the insertion section, the spacings between the grippers gripping the folding parts of a main product being larger than the spacing between the grippers gripping the folding parts of adjacent main products.

A further method variant comprises producing the asymmetrical suspended position of the main product relative to the median perpendicular between the two grippers, which hold the two folding parts of the main product in that the gripped edges remote from the fold of said two folding parts are not gripped at the same distance from the fold. In other words the front folding part $H_v$ of a main product in the conveying direction forms a shorter and the rear folding part $H_h$ in the conveying direction forms a longer suspended wall of the inserting pocket formed by the main product, so that even without any corresponding gripper position said pocket assumes a suspended position favourable for insertion purposes. A corresponding transfer from an inserting drum is described in detail in conjunction with FIG. 4.

FIG. 1 shows the insertion section as a substantially linear conveying section. Such a guidance of the pulling member 3 of the insertion section is not prescribed. The insertion section can have a gradient and/or curves without this having any effect on the inventive method.

FIG. 2 shows in greater detail than in FIG. 1 the method for accepting the folded main products from the inserting drum 2 by the grippers 4 of the insertion section 1. The inserting drum 2 has cells, which are separated from one another by radial partitions 21.1 to 21.4. The cell partitions are shown in sectional form with sectional planes stepwise displaced from 21.1 to 21.4 in the direction of the drum axis from areas of the latter in which the main products are inserted (entrance area 21.1 and 21.2) to the area of the drum in which the main products are accepted or taken over by the grippers of the insertion section (acceptance area 21.3 and 21.4). Once again in sectional view, the main products H.1 to H.3 can consequently be seen at different acceptance stages.

The insertion drum cells are substantially radially separated from one another by partitions 21.1 to 21.4 and extend in the drum axis direction by at least twice the width of the main products to be processed. On the bottom of each cell is located a conveying slide 22, which conveys a printed product in the cell in the direction of the drum axis from the entrance area into the acceptance area whilst being pressed by a pressure lever 23 against one conveying slide side and is in this way secured. On the cell partitions in the vicinity of the cell opening there are support plates 24 displaceable in the direction of the drum axis and which extend into two adjacent cells. The pulling member 3 of the insertion section 1 (diagrammatically shown as a dot-dash line) is so guided on the inserting drum that the grippers 4 in the top area of the drum reach the drum circumference and are oriented on the cell partitions.

The folded main products are inserted in the cells of the inserting drum 2 and opened (not visible in the drawing), so that, secured by the pressure lever 23, they are supported with the fold in the conveying slide 22. On opening the folding parts are separated from one another and essentially engage on the two partitions defining the cell. In the vicinity of their edges remote from the fold they are held in this position by the support plate 24 sliding over them. The conveying slide 22, pressure lever 23 and support plate 24 now move in the direction of the drum axis (at right angles to the paper plane of the drawing) and also move the main product into the drum acceptance area above which moves the grippers 4 of the insertion section 1. The cell partitions 21.3 and 21.4 are constructed as thin plates in this area and at least in the vicinity of the cell opening. The main products are supported by the support plates 24 until conveyed into the vicinity of the grippers 4 of the insertion section 1, where the grippers 4 assume the support function and the support plates 24 move back into the entrance area of the drum, where they once again support entering products. As soon as the main products are in the vicinity of the grippers 4, the pressure lever 23 is released, the gripper 4 closes and thereby secures the rear folding part (e.g. $H.3_h$) of a main product in the conveying direction F together with the front folding part (e.g. $H.2_v$) of the following product. The main products no longer secured in the conveying slide 22 are conveyed in the form of a virtually endless folding belt from the inserting drum into the insertion section.

FIG. 3 shows the main products conveyed by the grippers 4 in the conveying direction F through a part of the insertion section. The grippers 4 are controlled in such a way that the fold edges of the main products are moved between two grippers upstream of the median perpendicular. The detail shows how a further insert product E.4 is inserted in the main product H, which already contains three insert products E.1/2/3. Insert product E.4 is moved by a random, not shown conveying system with a freely suspended lower edge from above into the vicinity of the insertion section. The insert product E.4 is guided by a guide member 31 between two grippers 4, advantageously in a position in which the lower edge of the product is in advance of its upper edge in the conveying direction. As soon as the lower edge of the insert product E.4 has been adequately guided between the grippers 4, it can be released by the supply means and drops into the pocket formed by the main product H. If the main product is conveyed to the insertion point in such a way that the fold is in the conveying direction upstream of the median perpendicular between two grippers, the products E.1/2/3 already inserted in the main product engage on the rear folding part $H_h$ and the product E.4 also inserted with a leading lower edge will be placed upstream of the already inserted products in the conveying direction. As a result of such a "sloping" suspended position of the main products it is possible to achieve a clearly defined positioning of said insert products and an always free insertion opening for a further insertion process.

FIG. 4 shows for a further method variant an acceptance station U' for main products H by the grippers 4 of an insertion section in the same representation as in FIG. 2. It is once again a question of acceptance from an inserting drum, in which the main products are transferred in such a way that the folding part, (e.g. $H.4_v$) of each main product leading in the conveying direction F is gripped lower, i.e. closer to the fold than the trailing folding part (e.g. $H.5_h$) in the conveying direction. As stated, this can lead to an insertion-favourable, asymmetrical suspended position of the main products relative to the median perpendicular between the two grippers, so that the fold of the main product is located upstream of said median perpendicular in the conveying direction. Parts described with the same function in FIG. 2 are given the same reference numerals in FIG. 4.

The main difference compared with the transfer shown in FIG. 2 is that the main products are not gripped by the grippers in the upper area of the inserting drum and pulled out of the drum cells and instead this takes place in the drum sector in which the products move upwards and the cell partitions have a roughly horizontal position. In this inserting drum area each product is still held in the cell by a pressure lever 23.

Four cells of the inserting drum occupied by main products H.4 to H.7 are visible in FIG. 4 and are separated from one another by partitions 21.5, 21.6 and 21.7, which are shown in section at right angles to the drum axis. The main products H.4, H.5, H.6 and H.7 are also shown in sections and at different acceptance stages. The movement of the main products in the axial direction of the inserting drum and the opening of the main products is already concluded in this area of the drum. In the vicinity of its fold, each main product is pressed by the pressure lever 23 against the front cell partition (actually against the front part of the conveying slide 22). The front folding part, (e.g. $H.4_v$) of each main product in the conveying direction is held by a guidance member, e.g. a guidance rod 25 in such a way that it substantially engages on the front cell partition. The rear folding part, (e.g. $H.5_h$) in the conveying direction hangs freely in the cell from the point where it is held by the pressure lever 23 together with the front folding part and is pressed against the other, rear cell partition by gravity at the acceptance station U'. Thus, the front folding part substantially engages with the front cell partition, whereas the rear folding part extends from the front to the rear cell partition and consequently at the latter extends less far outwards. Thus, the two product edges gripped by a gripper are reciprocately displaced, so that the gripper grips the front folding part, (e.g. $H.4_v$) of a main product closer to the fold than the rear folding part (e.g. $H.5_h$) of the preceding main product.

The grippers 4 have the same function as the grippers of FIG. 2, being so synchronized with the inserting drum that they move against the latter oriented with the cell partitions.

FIGS. 5 and 6 show an exemplified embodiment of a gripper enabling the performance of the inventive insertion method as a view at right angles to the conveying direction (FIG. 5) and as a view parallel to the conveying direction and from the rear (FIG. 6). The gripper is a further development of that according to Swiss patent 644,816 of the same Applicant and which is here assumed as known. However, it is obvious that other grippers can be used.

The gripper comprises a quasi-stationary clamping tongue 41, which can be constructed in one piece with a gripper casing 42, as well as a movable clamping tongue 43, which is constructed in one piece with a not shown spiral spring. The gripper is connected with a shaft 44 to the pulling member 3. The shaft is mounted in rotary manner in a bearing 45 of the pulling member and in the casing 42. The latter can be pivoted about the axis of the shaft 44 by means of a first control roll 46, which is rotatably arranged on a control shaft 46.1 fixed to the casing 42 and can roll along the insertion section on control links 47.

A second control roll 48 is rotatably arranged on a connecting piece 49 fixed to the shaft 44 and determines the rotation position of the shaft 44 on rolling on a corresponding link 50. The spiral spring shaped onto the movable clamping tongue 43 is fixed to the shaft 44, so that the rotation position of the shaft 44 and the pivoting position of the casing determine the position of the movable clamping tongue 43 and the tension of the spiral spring.

With respect to the stationary clamping tongue, the movable clamping tongue 43 is held in an open position (shown in dot-dash line form) when the second control roll 48 runs on a corresponding link 50. If the second control roll 48 and with it the shaft 44 is rotated by a corresponding control link 50 in the direction of the arrow C and with the pivoting position of the casing 42 remaining unchanged, the movable clamping tongue 43 moves against the stationary clamping tongue 41, i.e. the gripper closes. When the movable tongue stops against the stationary tongue, the spring is tensioned. The gripper has a latching system, which fixes the two tongues in said closed position. The latching system e.g. comprises a detent 51 fixed to the shaft 44 and a corresponding notch 52 pivotably arranged on the casing. The notch is pressed into its latching position by a spring and is opened by a control link 53. When the latching system is engaged, the movable clamping tongue 43 is firmly connected to the stationary clamping tongue 41 and consequently the pivotability of the casing 42 relative to the shaft 44 is blocked. Both in the open and closed state the pivoting position of the gripper can be modified, in that the first control roll 46 is pivoted by corresponding control links 47, the two clamping tongues also being pivoted if the pivoting of the movable clamping tongue is not counteracted by corresponding links 50. FIG. 5 shows the gripper in a central position, in which a printed product is substantially vertically gripped, i.e. a folded printed product gripped by two adjacent grippers hangs symmetrically downwards. A pivoting of the first control roll 46 and therefore the gripper in the direction of the arrow B brings the latter into an insertion position, as shown in FIG. 3. A pivoting in the opposite direction produces an acceptance position, as is advantageous in the acceptance area (cf. FIGS. 2 and 4).

Spaced from the gripper support elements 54.1 and 54.2 can be provided on both sides and fixed to the shaft 44. These elements move with the movable clamping tongue during the closure of the gripper (acceptance) and correspondingly guide the product edges to be gripped. On the insertion section they are brought with the gripper into an insertion position, so that their lower part is in advance of the upper part. Such support elements are particularly advantageous if the main products to be conveyed are not very rigid and supporting by the gripper in its central area is not sufficient for a completely satisfactory insertion process.

The pulling member 3 can e.g. be constructed as a driven chain 54 in a channel 55. As the space above the grippers 4 must be free for insertion, it is necessary to position the grippers 4 laterally of the pulling member 3. As a function of the weight of the products and the apparatus embodiment a pulling member may only be placed on one side, or such a pulling member is provided on both sides. In the embodiment according to FIGS. 5 and 6 there is a pulling member on one side and a support roll 57 rolling on a rail 56 on the other.

FIGS. 7 and 8 show a further exemplified embodiment of a gripper (4') suitable for the inventive method and once again as a view at right angles to the conveying direction (FIG. 7) and as a view parallel to the conveying direction (FIG. 8). It is a further development of the gripper according to the FIGS. 5 and 6. The gripper 4' is substantially located below a corresponding pulling member 3', but the quasi-stationary clamping tongue 82 shaped onto the gripper casing 81 is so laterally widened that it extends by at least the width of the main product H to be processed laterally of the gripper casing 81. The shaft 83 carrying the gripper also extends over the same width and to it are fitted two movable clamping tongues 84.1 and 84.2 in the vicinity of the widened, quasi-stationary clamping tongue 82. The function of the gripper 4' is the same as that of FIGS. 5 and 6.

Over the shaft 83 projecting at one side from the gripper casing 81 is arranged in roof-like manner an insertion template 85, which moves with the gripper through the entire insertion section and serves as a guidance means for the products to be inserted.

FIG. 9 shows a further variant in connection with the acceptance of folded main products H by the grippers 4 of the insertion section 1. In this variant an inserting drum is not used for the supply and opening of the main products and it is replaced by a supply conveying means 90, which conveys the main products suspended and gripped at the fold, an opening means 91 for separating the freely hanging folding parts of the main products, i.e. the main products are opened, and a keeping open means 92 for keeping open the main products. The supply conveying means can be constituted by a clip or clamp conveyor, which takes over the main products e.g. at a transfer station from a scale flow or from a collecting drum. Opening means and keeping open means are known per se and are e.g. described in the Applicant's own two Swiss patent applications 2074/91-9 (applied for 11.7.91) and 1116/92-1 (applied for 6.4.92).

If, as shown in FIG. 9, for keeping open the main products use is e.g. made of guidance means 93 laterally inserted into the products opened by the opening means 91 and which also move in the conveying direction F, then the main products can also be asymmetrically opened. This is brought about in that the guidance means 93 are introduced substantially perpendicularly under the fold secured by the supply conveying means 90 into the only slightly opened main product and then move in the conveying direction somewhat more slowly than the means 90. Thus, the leading folding part $H_v$ in the conveying direction hangs substantially vertically, whereas the rear folding part $H_h$ in the conveying direction is deflected rearwards. If the rear folding part is deflected rearwards to such an extent that its edge remote from the fold approaches the front folding part of the following product, the two folding parts can be gripped by a gripper from the insertion section. The insertion pockets formed by main products gripped in this way have, like those of FIG. 4, a leading fold in the conveying direction, in that the front folding part $H_v$ is gripped closer to the fold than the rear folding part $H_h$.

The main products gripped from the supply conveying means by the grippers 4 of the insertion section 1 are rotated by a deflecting means 94 into the position necessary for insertion with a downwardly hanging fold and the insertion process takes place in the manner described hereinbefore.

I claim:

1. Method for inserting printed products (insert products E) in folded printed products (main products H), in which the main products (H) folded in two folding parts are conveyed into an acceptance station (U) and from there via an insertion section (1) to a delivery station (A) and along the insertion section (1) the insert products (E) are inserted, characterized in that the folded main products (H) are conveyed with the fold directed at right angles to the conveying direction (F) into the acceptance station (U), that at the acceptance station (U,U') the two folding parts of each main product (H) are gripped in the vicinity of the edges facing the fold by two conveying means spaced from one another in the conveying direction (F) and that the main products (H) are conveyed by said conveying means over the insertion section with a freely downwardly hanging fold, the insertion products (E) being inserted from above between the conveying means into the main products (H).

2. Method according to claim 1, characterized in that the rear folding part ($H_h$) of a main product (H) in the conveying direction (F) is gripped and conveyed by the same conveying means as the front folding part ($H_v$) of the next following main product in the conveying direction.

3. Method according to claim 1 characterized in that the hanging position of the main product (H) is modified during its conveying from the acceptance station (U) through the insertion section (1) to the delivery station (A).

4. Method according to claim 3, characterized in that the hanging position of the main product (H) at the insertion points is such that the fold is located, in the conveying direction (F), upstream of the median perpendicular between the two conveying means, which hold the two folding parts of the product.

5. Method according to claim 1 characterized in that at the acceptance station (U') the front folding part ($H_v$) of each main product (H) in the conveying direction (F) is gripped closer to the fold than the rear folding part ($H_h$), so that the hanging part of the front folding part is shorter than the hanging part of the rear folding part.

6. Method according to claim 5 characterized in that the insert products (E) are guided in freely suspended manner to the insertion section (1) and that the lower edge of each insert product (E) is guided by a stationary guide (31) for insertion purposes.

7. Method according to claim 6, characterized in that the insert products are also guided by an insertion template (85) moved with the conveying means.

8. Method according to claim 1 characterized in that during conveying over the insertion section (1) by modifying the spacing of the two conveying means, which hold the two folding parts of a main product (H), the latter is opened to a greater or lesser extent.

9. Method according to claim 1 characterized in that the folded main products (H) are guided as a scale flow into an inserting drum (2), are opened in the latter and from it conveyed away by the conveying means of the insertion section (1).

10. Method according to claim 1 characterized in that the folded main products (H) are supplied by a supply conveying means (90) in freely suspended manner and with substantially upwardly directed fold, that the hanging folding parts of each main product are separated from one another by an opening means (91), that the folded main products are kept open by a keeping open means (92), whilst the folding parts are gripped by the grippers (4,4') of the insertion section (1) and that the main products (H) are brought by deflection into the position necessary for insertion with the downwardly directed fold.

11. Method according to claim 10, characterized in that the keeping open means only act on the rear folding part ($H_h$) of the main product, whereas the front folding part ($H_v$) hangs substantially freely.

12. Method according to claim 11, characterized in that the keeping open means (92) are guidance means (93), which are inserted into the opened main products (H) laterally and substantially below the fold and are moved at a speed lower than that of the supply conveying means (93) and substantially parallel to the latter, so that the rear folding part ($H_h$) of each main product is deflected rearwards in the conveying direction, whereas the front folding part ($H_v$) hangs substantially freely.

13. Method according to claim 12 characterized in that the end product (HE) comprising the main product (H) and at least one inserted insert product (E), following the insertion section (1) is transferred to a transfer system (6).

14. Apparatus for inserting printed products characterized in that it has a supply means (2,90/91/92) for folded main products (H) guiding the folded main products in open form to an acceptance station (U,U'), that it has an insertion section (1) leading away from the acceptance station (U,U') with at least one pulling member (3,3') and grippers (4,4') and further supply means (5) for insert products (E) directed from above against the insertion section (1) and that the supply means (2) for the main products (H) and the grippers (4,4') of the insertion section (1) are so matched to one another that the grippers (4) and the centres of the main products (H) are displaced relative to one another at the acceptance station (U).

15. Apparatus according to claim 14, characterized in that the supply means (2) for the main products (H) is an inserting drum.

16. Apparatus according to claim 15, characterized in that the pulling member (3,3') of the insertion section is positioned in such a way that the acceptance station (U) is in the upper area of the inserting drum.

17. Apparatus according to claim 15, characterized in that the pulling member (3,3') of the insertion section is arranged in such a way that the acceptance station (U') is located in the area in which the cell partitions of the inserting drum move in rising manner through an approximately horizontal position.

18. Apparatus according to claim 14, characterized in that the supply means have a supply conveying means (90) for the freely hanging supply of the main products with the fold directed downwards, an opening means (91) for separating the hanging folding parts of the hanging supplied main products and a keeping open means (93) for keeping open the opened main products for the acceptance by the conveying means (4,4') of the insertion section (1) and that the pulling member (3,3') of the insertion section has a deflection between the acceptance station and the first insertion point.

19. Apparatus according to claim 18, characterized in that the keeping open means (91) have guidance means (93) insertable laterally into the opened main products and movable in the conveying direction parallel to the supply conveying means (90).

20. Conveyor for the insertion section of the apparatus according to claim 19 comprising at least one pulling member (3,3') and grippers, characterized in that the grippers (4,4') are arranged so as to pivot about a horizontal axis (44,83) on the pulling member (3,3').

21. Conveyor according to claim 20, characterized in that the gripper (4,4') is positioned laterally or below the pulling member.

22. Conveyor according to claim 21, characterized in that each gripper (4,4') is placed on a shaft (44,83), which on its one side is connected to the pulling member (3,3') and carries on the other side a support roll (57), which runs on a rail (56).

23. Conveyor according to claim 21, characterized in that the grippers (4,4') are positioned between two pulling members.

24. Conveyor according to claim 20 characterized in that each gripper (4,4') is fixed with a shaft (44,83) to the pulling member (3) and has a quasi-stationary clamping tongue (41,82) and at least one movable clamping tongue (43,84.1,84.2), the shaft (44) being pivotably mounted in a bearing (45) of the pulling member, the stationary clamping tongue (41,82) is rotatably positioned on the shaft and the movable clamping tongue (43) or the movable clamping tongues (84.1,84.2) are connected to the shaft (44,83) by means of a spring.

25. Gripper with shaft for conveyor according to claim 24, characterized in that the gripper has control means with which it is possible to control the pivoting position of the quasi-stationary clamping tongue (41) and the position of the movable clamping tongue (43) relative to the stationary clamping tongue (41).

26. Gripper according to claim 25, characterized in that as the control means a first and a second control roll (46,48) are provided.

27. Gripper according to claim 25 characterized in that the gripper has locking means (50,51) with which the two clamping tongues (41,43) can be fixed in the closed position and simultaneously the rotatability of the stationary clamping tongue (41) relative to the shaft (44) can be blocked.

28. Gripper according to claim 25 characterized in that the gripper is positioned centrally on the shaft (44) and that on said shaft (44) on either side of the gripper (4) there are support elements (54.1,54.2) fixed to said shaft (44).

29. Gripper with shaft for the conveyor according to claim 24, characterized in that the gripper (4') is positioned on one side on the shaft and that it has on one side a quasi-stationary clamping tongue (82) projecting over the gripper casing (81) and laterally of the latter at least two movable clamping tongues (84.1,84.2).

30. Gripper according to claim 29, characterized in that an insertion template (85) is arranged in roof-like manner over the shaft (83) laterally of the gripper casing (81).

* * * * *